US011022288B2

(12) United States Patent
Ouyang et al.

(10) Patent No.: US 11,022,288 B2
(45) Date of Patent: Jun. 1, 2021

(54) LED LIGHT APPARATUS

(71) Applicant: XIAMEN ECO LIGHTING CO. LTD., Xiamen (CN)

(72) Inventors: Xin Ouyang, Xiamen (CN); Yi Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/177,002

(22) Filed: Oct. 31, 2018

(65) Prior Publication Data

US 2020/0132288 A1 Apr. 30, 2020

(51) Int. Cl.
*F21V 23/00* (2015.01)
*F21V 17/08* (2006.01)
*F21V 23/02* (2006.01)

(52) U.S. Cl.
CPC ..... *F21V 23/008* (2013.01); *F21V 17/08* (2013.01); *F21V 23/002* (2013.01); *F21V 23/023* (2013.01)

(58) Field of Classification Search
CPC .... F21V 23/008; F21V 23/002; F21V 23/023; F21V 17/08
See application file for complete search history.

(56) References Cited

U.S. PATENT DOCUMENTS 5,679,023 A * 10/1997 Anderson, Jr. ..... H01R 25/162 362/147
5,767,999 A * 6/1998 Kayner ..... G06F 13/409 398/164
6,179,627 B1 * 1/2001 Daly ..... H01R 13/6658 439/354
6,851,867 B2 * 2/2005 Pang ..... G02B 6/3825 385/134
7,018,070 B2 * 3/2006 McCoy ..... H01R 33/0809 362/260
7,270,441 B2 * 9/2007 Fiene ..... F21V 23/026 336/107
7,494,244 B1 * 2/2009 Van Diep ..... F21S 2/00 362/234
7,923,907 B2 * 4/2011 Tessnow ..... F21K 9/00 313/46
8,262,250 B2 * 9/2012 Li ..... F21V 17/007 362/219
8,405,947 B1 * 3/2013 Green ..... F21S 8/026 361/103
8,845,144 B1 * 9/2014 Davis ..... F21S 8/02 362/364
2007/0171667 A1 * 7/2007 Watanabe ..... F21V 19/0015 362/545
2008/0242149 A1 * 10/2008 Konno ..... H01R 24/58 439/607.01

(Continued)

*Primary Examiner* — Tsion Tumebo
(74) *Attorney, Agent, or Firm* — Chun-Ming Shih; Lanway IPR Services

(57) ABSTRACT

A LED light apparatus is designed to being connected to an external power source via a host connector. The light source has a LED light source, a light housing, a driver circuit and a plastic device connector housing. The plastic device connector housing has a receiver socket for detachably receiving a corresponding plastic plug of the host connector. When the plastic plug of the host connector is inserted into the receiver socket, metal terminals of the host connector engage elongate flat front ends fixed to the plastic device connector housing.

18 Claims, 11 Drawing Sheets

(56) References Cited

U.S. PATENT DOCUMENTS

| | | | | |
|---|---|---|---|---|
| 2015/0241035 | A1* | 8/2015 | Dankelmann | F21V 21/005 362/219 |
| 2017/0214193 | A1* | 7/2017 | Tsai | H01R 13/502 |

* cited by examiner

LED LIGHT APPARATUS

FIELD OF INVENTION

The present invention is related to a LED light apparatus and more particularly related to a LED light apparatus for being conveniently installed.

BACKGROUND

There are various lighting apparatuses in the world. Different light apparatuses are designed for satisfying different needs. Among the lighting apparatuses, downlight apparatuses are important and widely seen in offices, houses, and various buildings.

When LED technologies are developing, more and more downlight apparatuses also start migrating into the LED field. For LED devices, they are usually more energy efficient and with larger luminance efficacy. Even LED devices have many advantages over traditional light source elements, LED devices also have some technical problems to be solved. For example, heat dissipation is always a key issue when designing LED lighting apparatuses. In addition, when lighting apparatuses use LED devices, they have smaller size than traditional lighting apparatuses. To better utilize such advantages, new designs may be introduced to provide more convenience, e.g. on installation.

Because downlight apparatuses are so important in human life, any advancement in such crowded field may bring huge advancement on human life and industrial field.

SUMMARY OF INVENTION

According to an embodiment of the present invention, a LED light apparatus is designed for being connected to an external power source via a host connector.

The LED light apparatus includes a LED light source and a light housing. The LED light source is disposed in the light housing and the light housing has an opening for light of the LED light source to emit outside the LED light apparatus.

The light housing may be designed as a downlight, a spot light, a panel light or other types of light devices. There may be other components like reflectors, diffusion plates, lens, heat sinks, light guide plates disposed in the light housing depending on different design requirements. The LED light source may be disposed on a light source plate or divided into multiple parts disposed on desired positions of the light housing for emitting light to desired angles.

The LED light apparatus also has a driver circuit coupled to the light housing for converting the external power source to a driving current supplying to the LED light source.

In some embodiments, the driver circuit may be placed in a driver box disposed in the light housing. In some other embodiments, the driver circuit may be disposed directly in the light housing without being placed in a separate container. In some other embodiments, the driver circuit may be disposed in an external box that is connected to the light housing. For example, the external box for containing the driver circuit may be fixed to a top of the light housing. In another example, the external box may be separate from the light housing but coupled to the light housing via a wire. All such various implementations are covered by the term "coupled to" referred here in the specification and the claims.

The LED light apparatus also has a plastic device connector housing and two device conductors. The plastic device connector has a receiver socket for detachably receiving a corresponding plastic plug of the host connector. The two device conductors are respectively disposed in two separate grooves of the plastic device connector housing.

Each device conductor has an elongated flat front end exposed for being physically engaged to a metal terminal embedded in the plastic plug of the host connector when the plastic plug of the host connector is inserted into the receiver socket.

When the plastic plug of the host connector is inserted into the receiver socket, the metal terminals of the host connector transmits electricity of the external power source to the elongated flat front of the device conductors, and the device conductors further transmit the electricity to the driver circuit. At least a portion of each device conductor is enclosed by the plastic device connector housing.

In some embodiments, the receiver socket of the plastic device connector housing has a track for the plastic plug of the host connector to slide in and has a stop structure for ensuring an engagement between the metal terminals of the host connector and the elongated flat front ends of the device conductors.

In such case, the plastic device connector housing serves as a female end corresponding to a male end of the host connector. Users of the LED light apparatus may hold the plastic plug of the host connector and insert into the receiver socket of the plastic device connector housing. The stop structure may be a protruding block for stopping the plastic plug entering too much, failing to place its metal terminal at correct contact position with respect to the elongated flat front end. A reverse hook may even be designed on the stop structure to hook the host connector to enhance attachment between the host connector and the plastic device connector housing.

The track helps users on guiding the plastic plug into the receiver socket, without causing undesired damage while connecting the two components.

In some embodiments, the engagement between the metal terminals of the host connector and the elongated flat front ends form an engagement span. In these embodiments, the elongated flat front ends in the engagement span are kept flat. In other words, in such case, the elongated flat front ends may be an elongated plate without a protruding or bent part thereon. Such design prevents unnecessary damage during connecting the host connector with the plastic device connector housing and the elongated flat front ends, thus increasing life span of the LED light apparatus.

In some embodiments, each metal terminal has a main flat part and an elastic curve portion near an end of the main flat part. The elongated flat front end is kept a tilt angle larger than 5 degrees with respect to the main part when the elongated flat front ends engage the metal terminals. With such design, there is a closer engagement when the plastic plug moves into the receiver socket more and more. Such design ensures a tight contact between the elongated flat front ends and the metal terminals, causing a reliable electrical contact for transmitting electricity.

In some other embodiments, each metal terminal has a main flat part and an elastic curve portion near an end of the main flat part. The elongated front end has a cavity for receiving the elastic curve portion when the elongated flat front ends engage the metal terminals. Specifically, the elastic curve portion may be deformed until meeting the cavity of the elongated flat front end. The elastic force of the elastic curve portion keeps the metal terminals staying in the cavity of the elongated flat front end to keep a reliable connection between the host connector and the plastic device connector housing.

In some embodiments, the device conductor has a tail portion exposed outside the plastic device connector housing. Specifically, the device conductor may be made of a metal sheet. A first end is formed as the elongated flat front end while a second end is formed as the tail portion. A portion of the device conductor is enclosed in the device connector housing while the tail portion is protruding outside the device connector housing.

The tail portion is located at an opposite end of the device conductor with respect to the elongated flat front end. The electricity of the external power source is routed firstly from the elongated flat front end and then to the tail portion before moving to the driver circuit. A wire may be disposed between the driver circuit and the device conductor for routing electricity of the external power source to the driver circuit. In other words, in such case, the wire is connected to the tail portion outside the plastic connector housing.

In some other embodiments, the tail portion is plugged into a driver socket electrically connected to the driver circuit. For example, the tail portion is a metal pin, the driver socket has an elastic clip. Inversed hooks or other fixing structures may be disposed for fixing the tail portion to the driver socket. In some design, the tail portion may even be a part of the driver socket. In other words, the plastic device connector housing may be inserted into the device conductors.

In some embodiments, the device conductor has a tail portion with a fixing structure for fixing the device conductor at a predetermined position of the plastic device connector housing. For example, the plastic device connector housing may have two through holes and the device conductors are respectively inserted into the two through holes. When the fixing structure reaches the predetermined position, the fixing structure, e.g. an inverse hook, the device conductor is fixed with respect to the plastic device connector housing by hooking the fixing structure to a corresponding slot or a blocking structure of the plastic device connector housing.

In some embodiments, the fixing structure is a bent hook with a bent angle with respect to the elongated flat front end. The fixing structure may be made by stamping processing applied on an elongated metal sheet. The bent angle with respect to the elongated flat front end may be less than 45 degrees, preferably 10 degrees to 30 degrees.

In some embodiments, the plastic device connector housing has an inner cavity for engaging the bent hook of the fixed structure.

In some embodiments, multiple protruding bars are formed on a surface of the elongated flat front end along an elongated axis of the elongated flat front end. Such protruding bars may enhance close contact between the device conductors and the metal terminals.

In some embodiments, a thickness of the elongated flat front end is smaller than a thickness of the metal terminal of the host connector. Such design may save cost. In addition, the elongated flat front end may be easier for slight deformation for close contact with the metal terminals.

In some other embodiments, for other design requirements, a thickness of the elongated flat end is thicker than a thickness of the metal terminal of the host connector. Such design may ensure a longer life span of the LED light apparatus. Furthermore, a larger thickness of conducting paths may reduce certain resistance and avoids unnecessary heat.

In some embodiments, the elongated flat front end is firmly fixed to the plastic device connector housing and does not deform even being engaged with the metal terminals. Specifically, a bottom side of the elongated flat front end may be firmly supported by the plastic device connector housing. With such design, the pressing force applied on the elongated flat front end by the metal terminals are transferred to the plastic device connector housing, instead of causing deformation of the elongated flat front end.

In some embodiments, the elongated flat front end has a protruding bent portion deformed when engaging with the metal terminal of the host connector. Such protruding bent portion may further correspond to an elastic curve portion of the metal terminal. When the protruding bent portion engages the elastic curve portion, a firm fixing force occurs from deformation of the elastic curve portion and the protruding bent portion.

In some embodiments, the light housing and the LED light source form a downlight. The light housing has a back cover. The plastic device connector housing is fixed to the back cover exposing the receiver socket for connecting to the host connector.

In some embodiments, the plastic device connector housing has the same color as the host connector, while the plastic device connector has a different color from the light housing. Such design helps users to pick necessary connecting structures easily and guides users to perform necessary connection via visual appearance. Under experiments, such design helps save at least 30% of time on finding how to connect the components for ordinary people.

In some embodiments, the elongated flat front end has a chamfer at an engaging end of elongated flat front end facing the host connector. The chamfer is a processed edge so as to prevent undesired damage during engagement of the host connector and the device conductors.

In some embodiments, the elongated flat front end has a smaller hardness than the metal terminal of the host connector. The elongated front end, in such design, would be easier to receive the connection of the metal terminal. By adjusting alloy composition, designers may adjust hardness of the device conductors.

DETAILED DESCRIPTION

Figure 1:
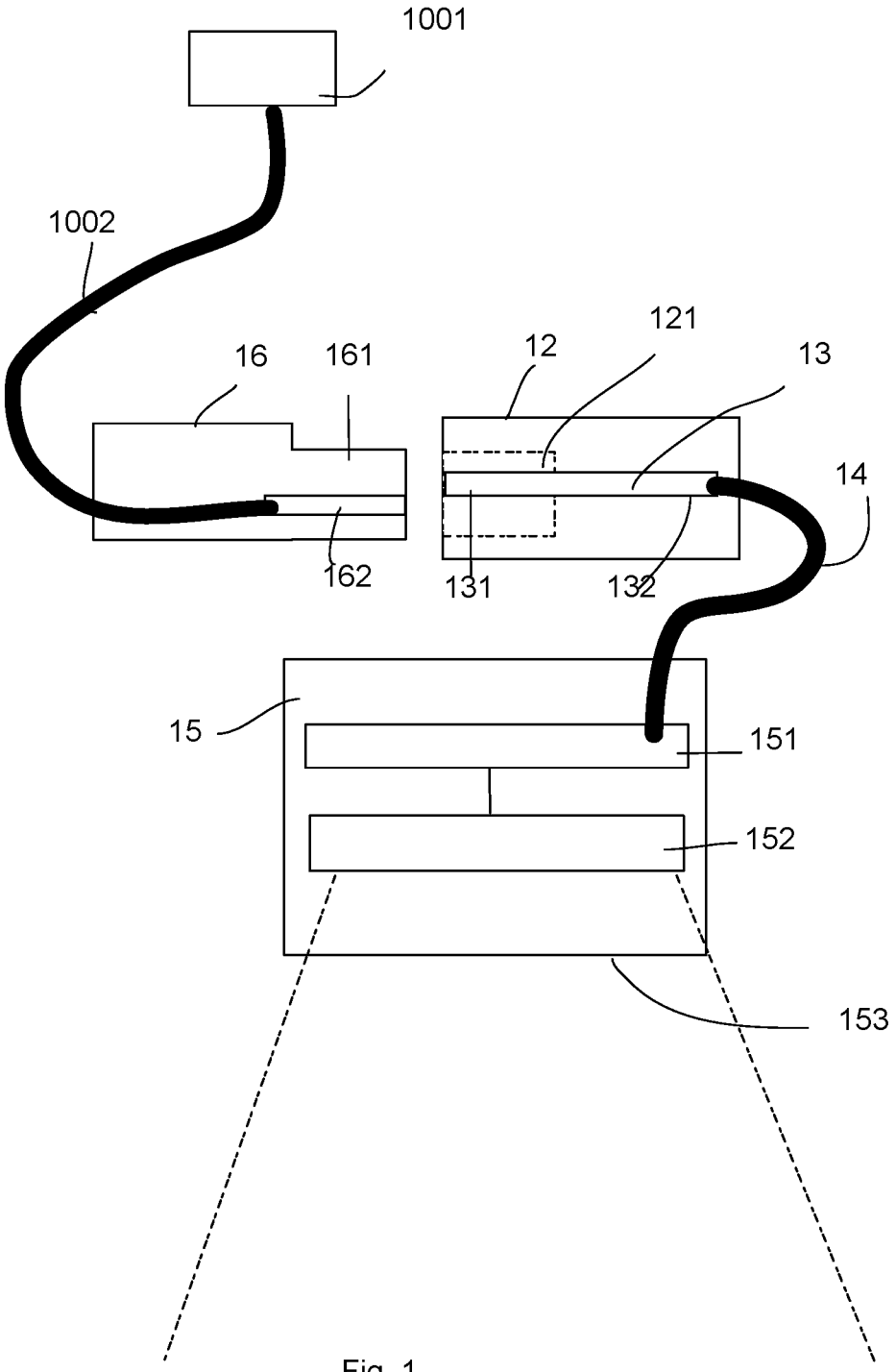
FIG. 1 is a diagram illustrating component relation in an embodiment.

Please refer to FIG. 1. FIG. 1 is a diagram illustrating component relation in an embodiment.

In FIG. 1, a LED light apparatus is designed to be connected to an external power source 1001 via a host connector 16. The host connector 16 has a plastic plug 161. In this example, two metal terminals 162 are embedded in the plastic plug 161. The metal terminals 162 are connected to the external power source 1001 via a wire 1002.

The LED light apparatus includes a light housing 15. In the light housing 15, there are a driver circuit 151 and a LED light source 152. The light housing 15 also has an opening 153 for light of the LED light source 152 to escape out of the LED light apparatus.

In this example, there is a wire 14 connecting the driver circuit to tail portions of the device conductors 13. In this example, there are two device conductors corresponding to two electrical wires of the wire 14. The device conductors 13 are disposed to the plastic device connector housing 12. The plastic device connector housing 12 has a receiver socket 121 for receiving the plastic plug 161 of the host connector. When the plastic plug 161 is inserted into the receiver socket 121, the metal terminals are engaged with elongated flat front ends 131 of the device conductors 13.

According to an embodiment of the present invention, a LED light apparatus is designed for being connected to an external power source via a host connector.

The LED light apparatus includes a LED light source and a light housing. The LED light source is disposed in the light housing and the light housing has an opening for light of the LED light source to emit outside the LED light apparatus.

The light housing may be designed as a downlight, a spot light, a panel light or other types of light devices. There may be other components like reflectors, diffusion plates, lens, heat sinks, light guide plates disposed in the light housing depending on different design requirements. The LED light source may be disposed on a light source plate or divided into multiple parts disposed on desired positions of the light housing for emitting light to desired angles.

The LED light apparatus also has a driver circuit coupled to the light housing for converting the external power source to a driving current supplying to the LED light source.

In some embodiments, the driver circuit may be placed in a driver box disposed in the light housing. In some other embodiments, the driver circuit may be disposed directly in the light housing without being placed in a separate container. In some other embodiments, the driver circuit may be disposed in an external box that is connected to the light housing. For example, the external box for containing the driver circuit may be fixed to a top of the light housing. In another example, the external box may be separate from the light housing but coupled to the light housing via a wire. All such various implementations are covered by the term "coupled to" referred here in the specification and the claims.

The LED light apparatus also has a plastic device connector housing and two device conductors. The plastic device connector has a receiver socket for detachably receiving a corresponding plastic plug of the host connector. The two device conductors are respectively disposed in two separate grooves of the plastic device connector housing.

Each device conductor has an elongated flat front end exposed for being physically engaged to a metal terminal embedded in the plastic plug of the host connector when the plastic plug of the host connector is inserted into the receiver socket.

When the plastic plug of the host connector is inserted into the receiver socket, the metal terminals of the host connector transmits electricity of the external power source to the elongated flat front of the device conductors, and the device conductors further transmit the electricity to the driver circuit. At least a portion of each device conductor is enclosed by the plastic device connector housing.

Figure 2A:
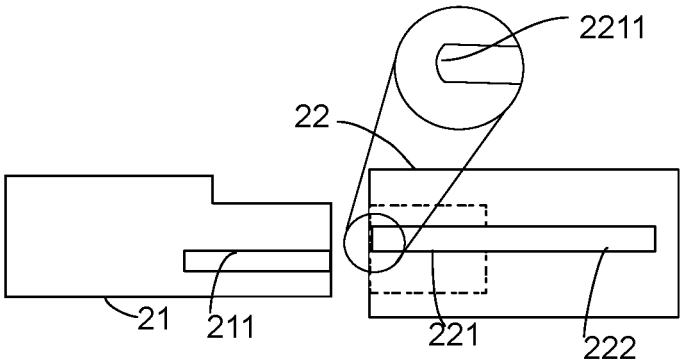
FIG. 2A is a side view diagram illustrating a host connector and a device connector when they are not connected.
Figure 2B:
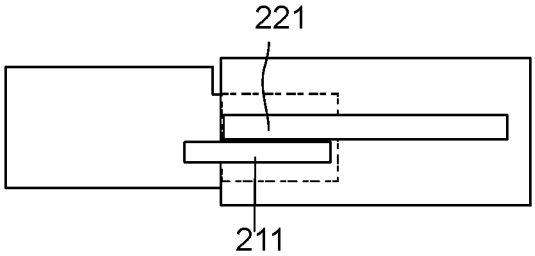
FIG. 2B is a side view diagram illustrating the host connector connected to the device connector.

Please refer to FIG. 2A and FIG. 2B. FIG. 2A is a side view diagram illustrating a host connector and a device connector when they are not connected. FIG. 2B is a side view diagram illustrating the host connector connected to the device connector.

In FIG. 2A and FIG. 2B, the host connector 21 has a metal terminal 211, and the device connector 22 has a device conductor that has an elongated flat front end 221 and a tail portion 222. When the host connector 21 is inserted to the device connector 22, the metal terminal 211 is engaged with the elongated flat front end. The elongated front end 221 is exposed in the space of the receiver socket so as to contact the metal terminal 211.

In some embodiments, the receiver socket of the plastic device connector housing has a track for the plastic plug of the host connector to slide in and has a stop structure for ensuring an engagement between the metal terminals of the host connector and the elongated flat front ends of the device conductors.

In such case, the plastic device connector housing serves as a female end corresponding to a male end of the host connector. Users of the LED light apparatus may hold the plastic plug of the host connector and insert into the receiver socket of the plastic device connector housing. The stop structure may be a protruding block for stopping the plastic plug entering too much, failing to place its metal terminal at correct contact position with respect to the elongated flat front end. A reverse hook may even be designed on the stop structure to hook the host connector to enhance attachment between the host connector and the plastic device connector housing.

The track helps users on guiding the plastic plug into the receiver socket, without causing undesired damage while connecting the two components.

In some embodiments, the engagement between the metal terminals of the host connector and the elongated flat front ends form an engagement span. In these embodiments, the elongated flat front ends in the engagement span are kept flat. In other words, in such case, the elongated flat front ends may be an elongated plate without a protruding or bent part thereon. Such design prevents unnecessary damage during connecting the host connector with the plastic device connector housing and the elongated flat front ends, thus increasing life span of the LED light apparatus.

In some embodiments, each metal terminal has a main flat part and an elastic curve portion near an end of the main flat part. The elongated flat front end is kept a tilt angle larger than 5 degrees with respect to the main part when the elongated flat front ends engage the metal terminals. With such design, there is a closer engagement when the plastic plug moves into the receiver socket more and more. Such design ensures a tight contact between the elongated flat front ends and the metal terminals, causing a reliable electrical contact for transmitting electricity.

Figure 3:
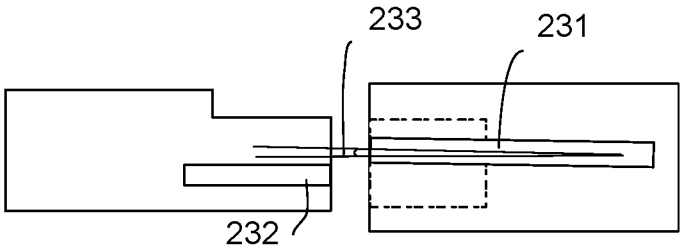
FIG. 3 illustrates a tilt angle between a metal terminal and an elongated flat front end.

Please refer to FIG. 3. FIG. 3 illustrates a tilt angle between a metal terminal and an elongated flat front end.

In FIG. 3, the elongated flat front end 231 is disposed in the plastic device connector housing with a tilt angle 233 with respect to the metal terminal 232. Therefore, when the metal terminal 232 is inserted to engage the elongated flat front end 231, the more the metal terminal is inserted, there is a closer contact between the metal terminal 232 and the elongated flat front end 231.

Figure 4:
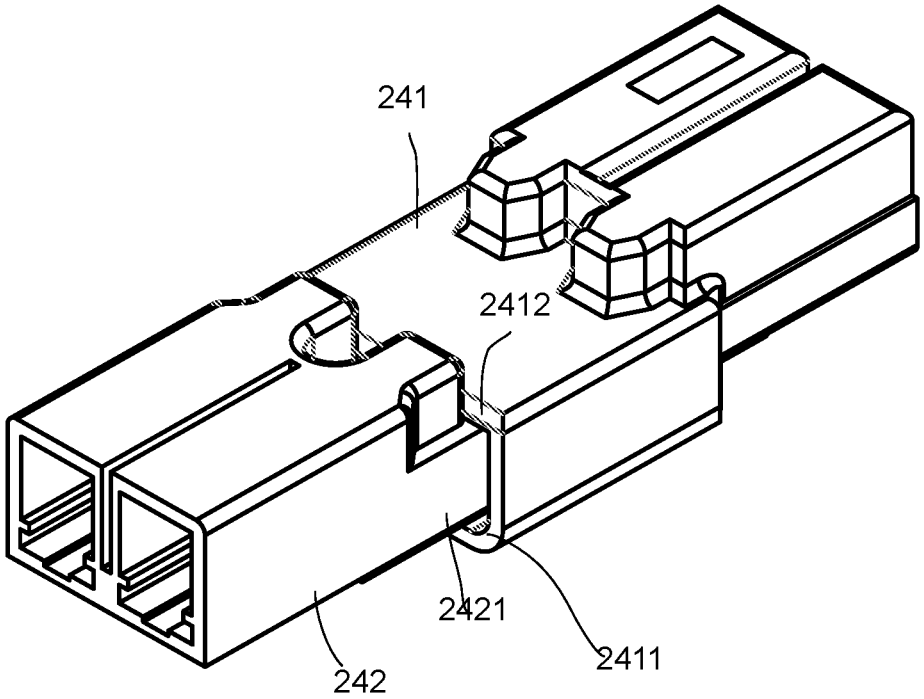
FIG. 4 illustrates another connector embodiment when two connectors are connected.
Figure 5:
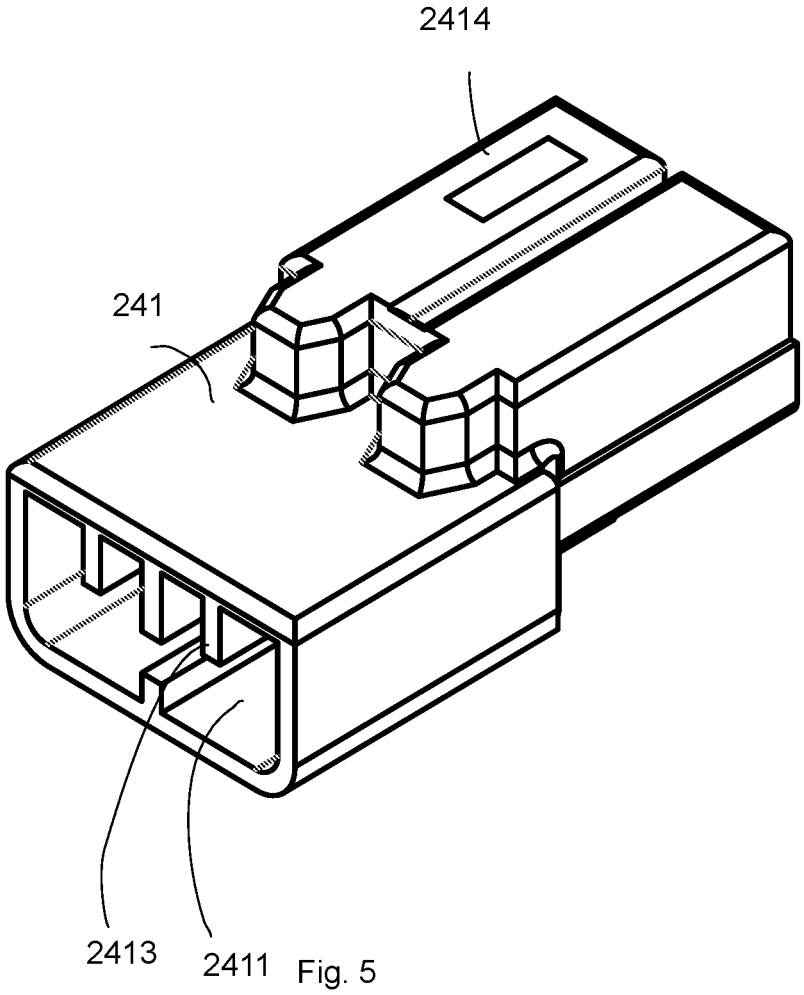
FIG. 5 illustrates a device connector embodiment.
Figure 6:
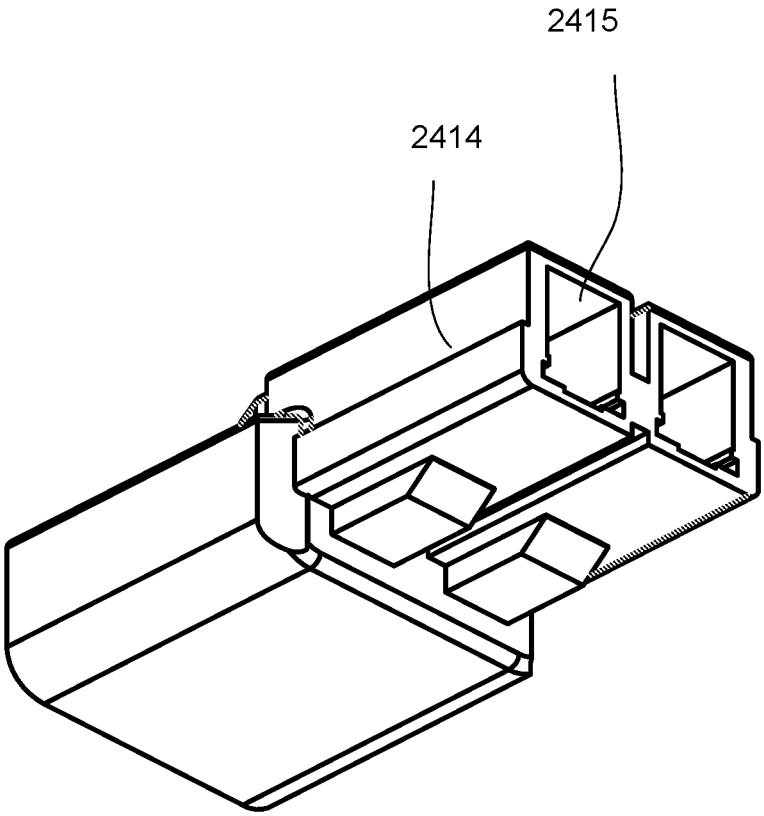
FIG. 6 illustrates another view of the embodiment of FIG. 5.

Please refer to FIG. 4, FIG. 5 and FIG. 6. FIG. 4 illustrates another connector embodiment when two connectors are connected. FIG. 5 illustrates a device connector embodiment. FIG. 6 illustrates another view of the embodiment of FIG. 5.

In FIG. 4, a host connector 242 has a plastic plug 2421 inserted into a receiver socket 2411 of a device connector 241. There is a stop structure 2412, the wall side of the receiver socket 2411 to limit entering distance of the host connector 242.

In FIG. 5 and FIG. 6, it is illustrated that the device connector 241 has a receiver socket 2411 in its front end and a wire socket 2415 in its back end 2414. There is also a track structure 2413 for guiding the plastic plug of the host connector to slide into the receiver socket 2411 of the device connector 241.

Figure 7A:
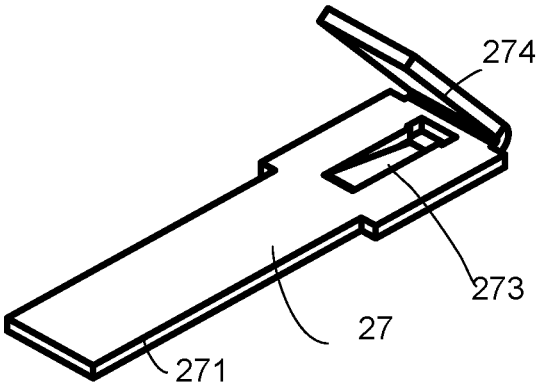
FIG. 7A illustrates a device conductor example.
Figure 7B:
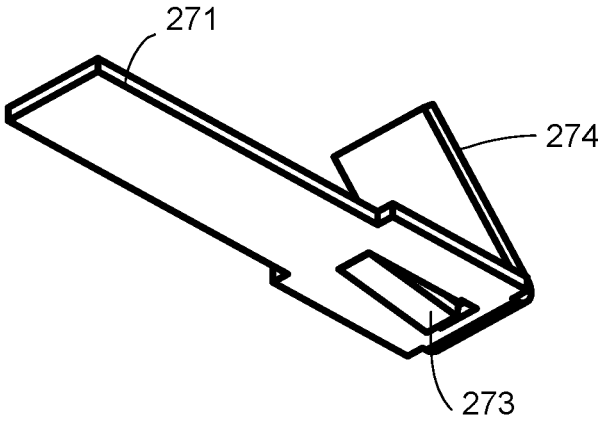
FIG. 7B illustrates another view of the device conductor example of FIG. 7A.
Figure 7C:
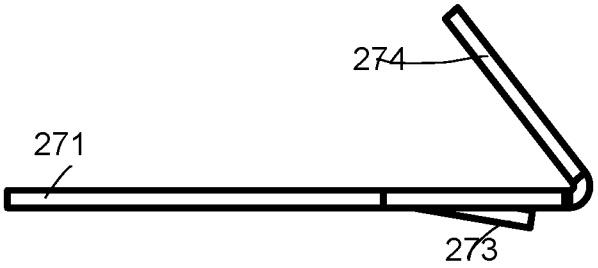
FIG. 7C illustrates a side view of the device conductor example of FIG. 7A.

Please refer to FIG. 7A, FIG. 7B and FIG. 7C. FIG. 7A illustrates a device conductor example. FIG. 7B illustrates another view of the device conductor example of FIG. 7A. FIG. 7C illustrates a side view of the device conductor example of FIG. 7A.

As explained above, the device conductor 27 is disposed in the plastic device connector housing. There is an inverse hook 273 for fixing the device conductor 27 at a predetermined position of the plastic device connector housing. There is also a bent hook 274 for engaging a wire. The device conductor 27 has an elongated flat front end 271 to be engaged with a corresponding metal terminal, as described above.

Figure 8A:
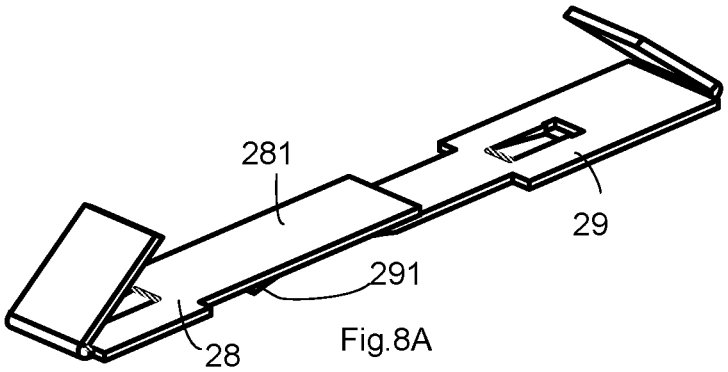
FIG. 8A illustrates engagement between a metal terminal and a device conductor.
Figure 8B:
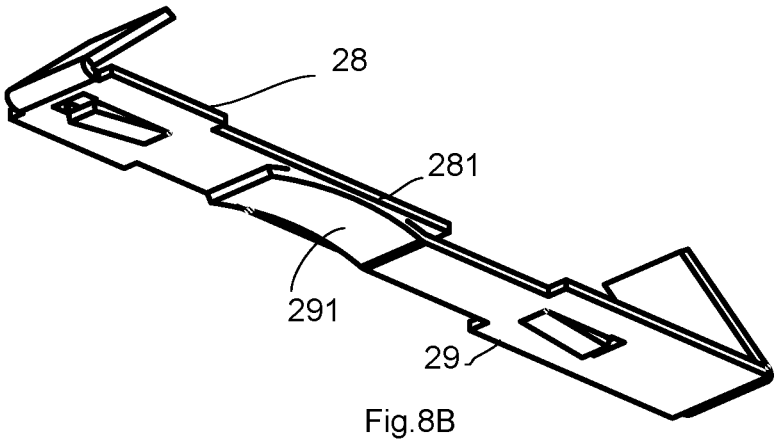
FIG. 8B illustrates another view of the example of FIG. 8A.
Figure 8C:
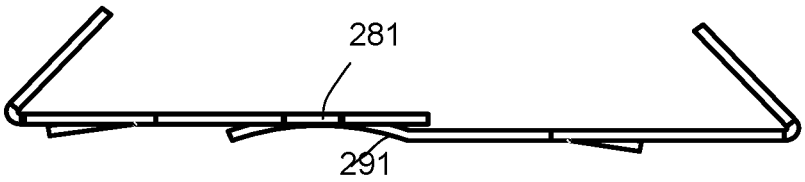
FIG. 8C illustrates a side view of the example of FIG. 8A.

Please refer to FIG. 8A, FIG. 8B and FIG. 8C. FIG. 8A illustrates engagement between a metal terminal and a device conductor. FIG. 8B illustrates another view of the example of FIG. 8A. FIG. 8C illustrates a side view of the example of FIG. 8A.

In FIG. 8A, a device conductor 28 is engaged with a metal terminal 29. Specifically, the device conductor 28 has an elongated flat front end 281 engaged with a front end 291 of the metal terminal 29. There is a curve portion at the front end 291 as illustrated in FIG. 8B and FIG. 8C. In contrast, the elongated flat front end 281 is not curved or bent in the engagement span, but keeps flat in this example.

In some other embodiments, each metal terminal has a main flat part and an elastic curve portion near an end of the main flat part. The elongated front end has a cavity for receiving the elastic curve portion when the elongated flat front ends engage the metal terminals. Specifically, the elastic curve portion may be deformed until meeting the cavity of the elongated flat front end. The elastic force of the elastic curve portion keeps the metal terminals staying in the cavity of the elongated flat front end to keep a reliable connection between the host connector and the plastic device connector housing.

In some embodiments, the device conductor has a tail portion exposed outside the plastic device connector housing. Specifically, the device conductor may be made of a metal sheet. A first end is formed as the elongated flat front end while a second end is formed as the tail portion. A portion of the device conductor is enclosed in the device connector housing while the tail portion is protruding outside the device connector housing.

The tail portion is located at an opposite end of the device conductor with respect to the elongated flat front end. The electricity of the external power source is routed firstly from the elongated flat front end and then to the tail portion before moving to the driver circuit. A wire may be disposed between the driver circuit and the device conductor for routing electricity of the external power source to the driver circuit. In other words, in such case, the wire is connected to the tail portion outside the plastic connector housing.

In some other embodiments, the tail portion is plugged into a driver socket electrically connected to the driver circuit. For example, the tail portion is a metal pin, the driver socket has an elastic clip. Inversed hooks or other fixing structures may be disposed for fixing the tail portion to the driver socket. In some design, the tail portion may even be a part of the driver socket. In other words, the plastic device connector housing may be inserted into the device conductors.

In some embodiments, the device conductor has a tail portion with a fixing structure for fixing the device conductor at a predetermined position of the plastic device connector housing. For example, the plastic device connector housing may have two through holes and the device conductors are respectively inserted into the two through holes. When the fixing structure reaches the predetermined position, the fixing structure, e.g. an inverse hook, the device conductor is fixed with respect to the plastic device connector housing by hooking the fixing structure to a corresponding slot or a blocking structure of the plastic device connector housing.

In some embodiments, the fixing structure is a bent hook with a bent angle with respect to the elongated flat front end. The fixing structure may be made by stamping processing applied on an elongated metal sheet. The bent angle with respect to the elongated flat front end may be less than 45 degrees, preferably 10 degrees to 30 degrees.

In some embodiments, the plastic device connector housing has an inner cavity for engaging the bent hook of the fixed structure.

In some embodiments, multiple protruding bars are formed on a surface of the elongated flat front end along an elongated axis of the elongated flat front end. Such protruding bars may enhance close contact between the device conductors and the metal terminals.

In some embodiments, a thickness of the elongated flat front end is smaller than a thickness of the metal terminal of the host connector. Such design may save cost. In addition, the elongated flat front end may be easier for slight deformation for close contact with the metal terminals.

In some other embodiments, for other design requirements, a thickness of the elongated flat end is thicker than a thickness of the metal terminal of the host connector. Such design may ensure a longer life span of the LED light apparatus. Furthermore, a larger thickness of conducting paths may reduce certain resistance and avoids unnecessary heat.

In some embodiments, the elongated flat front end is firmly fixed to the plastic device connector housing and does not deform even being engaged with the metal terminals. Specifically, a bottom side of the elongated flat front end may be firmly supported by the plastic device connector housing. With such design, the pressing force applied on the elongated flat front end by the metal terminals are transferred to the plastic device connector housing, instead of causing deformation of the elongated flat front end.

In some embodiments, the elongated flat front end has a protruding bent portion deformed when engaging with the metal terminal of the host connector. Such protruding bent portion may further correspond to an elastic curve portion of the metal terminal. When the protruding bent portion engages the elastic curve portion, a firm fixing force occurs from deformation of the elastic curve portion and the protruding bent portion.

In some embodiments, the light housing and the LED light source form a downlight. The light housing has a back cover. The plastic device connector housing is fixed to the back cover exposing the receiver socket for connecting to the host connector.

Figure 9:
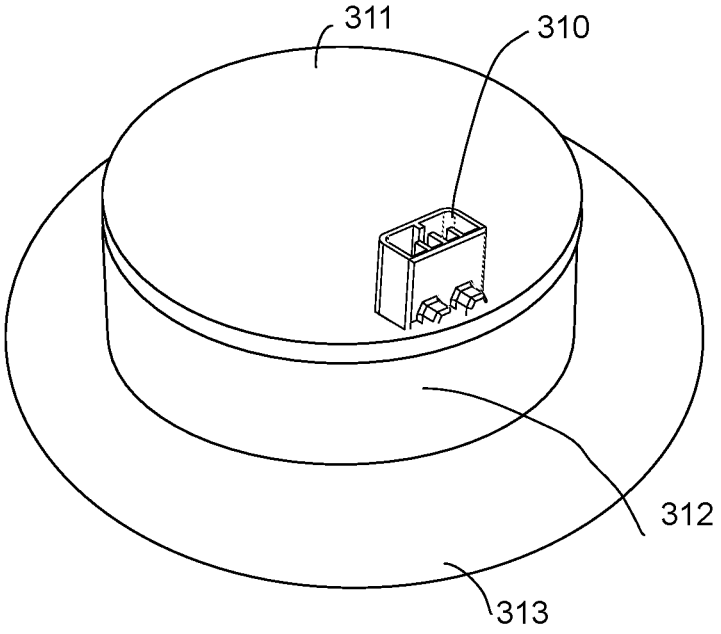
FIG. 9 illustrates another embodiment.
Figure 10:
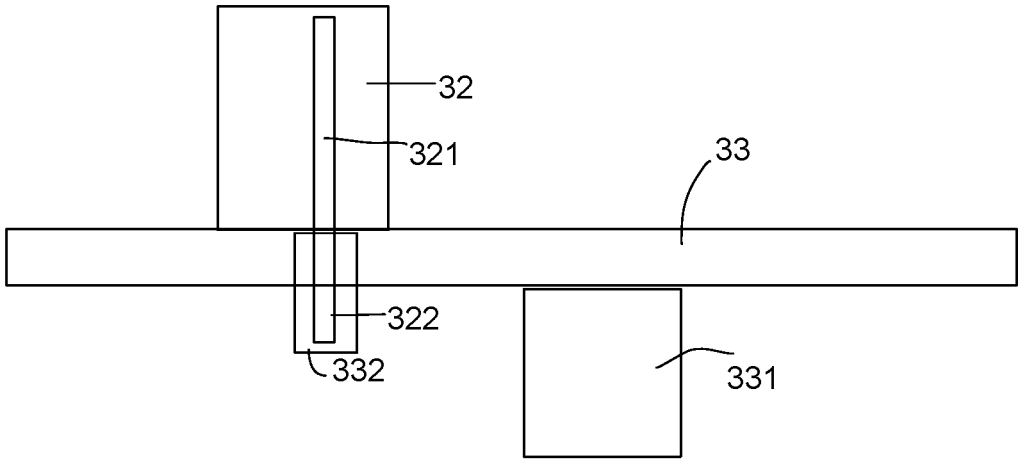
FIG. 10 illustrates component relation in embodiments like FIG. 9.

Please refer to FIG. 9 and FIG. 10. FIG. 9 illustrates another embodiment. FIG. 10 illustrates component relation in embodiments like FIG. 9.

In FIG. 9, the device connector 310, unlike the examples illustrated in previous drawings, the device connector 310 is directly integrated with a back cover 311 of the light housing 312. The light housing forms a downlight device with an opening rim 313. The receiver socket for inserting the plastic plug of the same host connector is kept unchanged. However, the back part of the device connector has a different design.

In FIG. 10, a back cover, which in this example also used for mounting a driver circuit 311, is integrated with the device connector 32. There is still an elongated flat front end 321 of the device conductor facing to a corresponding metal terminal of a host connector. On the other hand, the tail portion 322 of the device conductor is inserted to a socket 332, which routes electricity to the driver circuit 331.

Please note that there are various alternative ways to mount the device connector to the light housing. For example, the tail portion 322 of the device conductor may be welded directly on a printed circuit board that is used for mounting a driver circuit.

In some embodiments, the plastic device connector housing has the same color as the host connector, while the plastic device connector has a different color from the light housing. Such design helps users to pick necessary connecting structures easily and guides users to perform necessary connection via visual appearance. Under experiments, such design helps save at least 30% of time on finding how to connect the components for ordinary people.

In some embodiments, the elongated flat front end has a chamfer at an engaging end of elongated flat front end facing the host connector. The chamfer is a processed edge so as to prevent undesired damage during engagement of the host connector and the device conductors.

In some embodiments, the elongated flat front end has a smaller hardness than the metal terminal of the host connector. The elongated front end, in such design, would be easier to receive the connection of the metal terminal. By adjusting alloy composition, designers may adjust hardness of the device conductors.

Figure 11A:
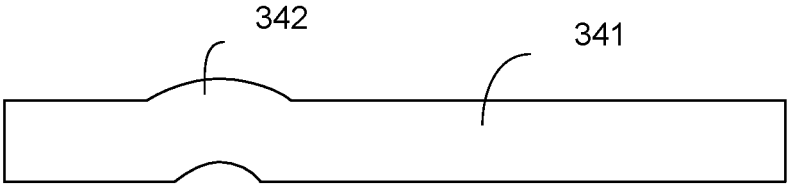
FIG. 11A shows another embodiment of the device conductor.
Figure 11B:
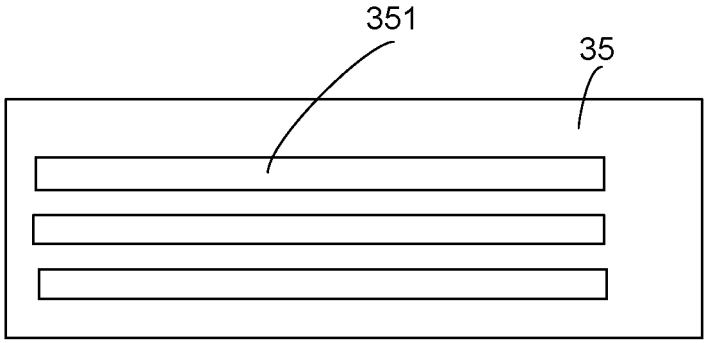
FIG. 11B shows another embodiment of the device conductor.
Figure 11C:
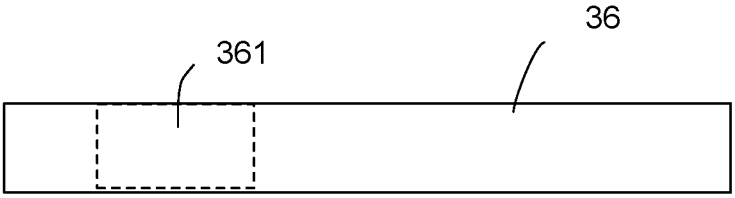
FIG. 11C shows another embodiment of the device conductor.
Figure 11D:
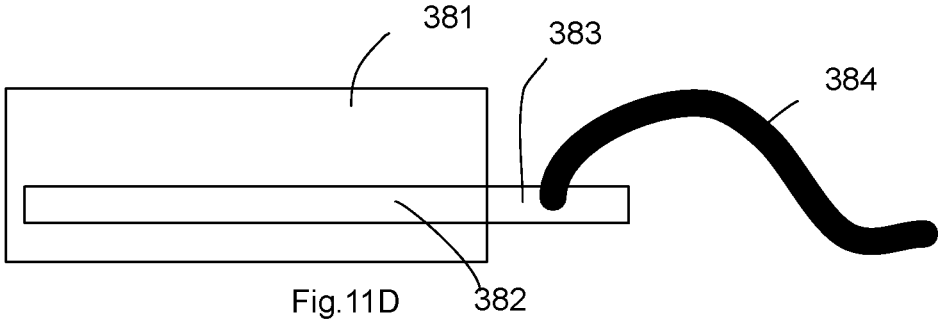
FIG. 11D shows another embodiment of the device conductor.

Please refer to FIG. 11A, FIG. 11B, FIG. 11C and FIG. 11D. FIG. 11A shows another embodiment of the device conductor. FIG. 11B shows another embodiment of the device conductor. FIG. 11C shows another embodiment of the device conductor. FIG. 11D shows another embodiment of the device conductor.

In FIG. 11A, it is illustrated that an elongated flat front end has a protruding bent portion 342 corresponding to the metal terminal of the host connector. Such design may enhance engagement between the device conductor and the metal terminal.

In FIG. 11B, there are multiple protruding bars 351 are formed on a surface of the elongated flat front end 35 along an elongated axis of the elongated flat front end.

In FIG. 11C, there is a cavity 361 disposed in the elongated flat front end 36 for receiving a curve portion of a metal terminal for enhancing engagement between connectors.

FIG. 11D, the device conductor 382 has a tail portion 383 outside the plastic device connector housing 381. Specifically, the exposed tail portion 383 is attached to a wire 384 outside the plastic device connector housing 381.

In addition to the above-described embodiments, various modifications may be made, and as long as it is within the spirit of the same invention, the various designs that can be made by those skilled in the art are belong to the scope of the present invention.

The invention claimed is:

1. A LED light apparatus for being connected to an external power source via a host connector, comprising:

a LED light source;

a light housing with an opening for disposing the LED light source, the LED light source emitting light from the opening;

a driver circuit coupled to the light housing for converting the external power source to a driving current supplying to the LED light source;

a plastic device connector housing with a receiver socket for detachably receiving a corresponding plastic plug of the host connector; and two device conductors respectively disposed inside two separate grooves of the plastic device connector housing with a surrounding wall covering the two device conductors, each device conductor having an elongated flat front end exposed for being physically engaged to a metal terminal embedded in the plastic plug of the host connector when the plastic plug of the host connector is inserted into the receiver socket, wherein when the plastic plug of the host connector is inserted into the receiver socket, the metal terminals of the host connector transmits electricity of the external power source to the elongated flat front of the device conductors, and the device conductors further transmit the electricity to the driver circuit, and wherein a portion of each device conductor is enclosed by the plastic device connector housing, wherein the receiver socket of the plastic device connector housing has a track for the plastic plug of the host connector to slide in and has a stop structure for ensuring an engagement between the metal terminals of the host connector and the elongated flat front ends of the device conductors, wherein the engagement between the metal terminals of the host connector and the elongated flat front ends form an engagement span, the elongated flat front ends and the metal terminals in the engagement span are both kept flat.

2. The LED light apparatus of claim 1, wherein each metal terminal has a main flat part and an elastic curve portion near an end of the main flat part, and the elongated flat front end is kept a tilt angle larger than 5 degrees with respect to the main part when the elongated flat front ends engage the metal terminals.

3. The LED light apparatus of claim 1, wherein each metal terminal has a main flat part and an elastic curve portion near an end of the main flat part, and the elongated front end has a cavity for receiving the elastic curve portion when the elongated flat front ends engage the metal terminals.

4. The LED light apparatus of claim 1, wherein the device conductor has a tail portion exposed outside the plastic device connector housing, the tail portion is located at an opposite end of the device conductor with respect to the elongated flat front end, the electricity of the external power source is routed firstly from the elongated flat front end and then to the tail portion before moving to the driver circuit.

5. The LED light apparatus of claim 4, wherein the tail portion is attached to a wire connecting to the driver circuit.

6. The LED light apparatus of claim 4, wherein the tail portion is plugged into a driver socket electrically connected to the driver circuit.

7. The LED light apparatus of claim 1, wherein the device conductor has a tail portion having a fixing structure for fixing the device conductor at a predetermined position of the plastic device connector housing.

8. The LED light apparatus of claim 7, wherein the fixing structure is a bent hook with a bent angle with respect to the elongated flat front end.

9. The LED light apparatus of claim 8, wherein the plastic device connector housing has an inner cavity for engaging the bent hook of the fixed structure.

10. The LED light apparatus of claim 1, wherein a plurality of protruding bars are formed on a surface of the elongated flat front end along an elongated axis of the elongated flat front end.

11. The LED light apparatus of claim 1, wherein a thickness of the elongated flat front end is smaller than a thickness of the metal terminal of the host connector.

12. The LED light apparatus of claim 1, wherein a thickness of the elongated flat end is thicker than a thickness of the metal terminal of the host connector.

13. The LED light apparatus of claim 1, wherein the elongated flat front end is firmly fixed to the plastic device connector housing and does not deform even being engaged with the metal terminals.

14. The LED light apparatus of claim 1, wherein the elongated flat front end has a protruding bent portion deformed when engaging with the metal terminal of the host connector.

15. The LED light apparatus of claim 1, wherein the light housing and the LED light source form a downlight, the light housing has a back cover, the plastic device connector housing is fixed to the back cover exposing the receiver socket for connecting to the host connector.

16. The LED light apparatus of claim 1, wherein the plastic device connector housing has the same color as the host connector, and the plastic device connector has a different color from the light housing.

17. The LED light apparatus of claim 1, wherein the elongated flat front end has a chamfer at an engaging end of elongated flat front end facing the host connector.

18. The LED light apparatus of claim 1, wherein the elongated flat front end has a smaller hardness than the metal terminal of the host connector.

* * * * *